US010239733B2

(12) United States Patent
Belder et al.

(10) Patent No.: US 10,239,733 B2
(45) Date of Patent: Mar. 26, 2019

(54) FLANGE LIFTING TOOL

(71) Applicant: IHC Holland IE B.V., Sliedrecht (NL)

(72) Inventors: Cornelis Belder, Oudewater (NL); Quintus Wilhelmus Petrus Maria Zuijdgeest, Zoetermeer (NL)

(73) Assignee: IHC Holland IE B.V., Sliedrecht (NL)

( * ) Notice: Subject to any disclaimer, the term of this patent is extended or adjusted under 35 U.S.C. 154(b) by 24 days.

(21) Appl. No.: 15/574,848

(22) PCT Filed: May 18, 2016

(86) PCT No.: PCT/EP2016/061125
§ 371 (c)(1),
(2) Date: Nov. 17, 2017

(87) PCT Pub. No.: WO2016/184905
PCT Pub. Date: Nov. 24, 2016

(65) Prior Publication Data

US 2018/0127245 A1 May 10, 2018

(30) Foreign Application Priority Data

May 19, 2015 (NL) ..... 2014823

(51) Int. Cl.
*B66C 1/54* (2006.01)

(52) U.S. Cl.
CPC ..... *B66C 1/54* (2013.01)

(58) Field of Classification Search
CPC ..... B66C 1/54
(Continued)

(56) References Cited

U.S. PATENT DOCUMENTS 2,156,651 A * 5/1939 Gardiner ..... F16L 1/10 29/272
2,370,482 A * 2/1945 Weld ..... B66C 1/54 29/261
(Continued)

FOREIGN PATENT DOCUMENTS

DE 8900457 U1 3/1989
EP 2837741 A2 2/2015
(Continued)

OTHER PUBLICATIONS

IHC Handling Systems B.V., Flange Pile Upending Tool (FPUT), Apr. 22, 2015, http://www.ihchs.com/wind/monopiles/flange-pile-upending-tool/.

*Primary Examiner* — Paul T Chin
(74) *Attorney, Agent, or Firm* — N.V. Nederlandsch Octrooibureau; Catherine A. Shultz; Tamara C. Stegmann

(57) ABSTRACT

The invention relates to a lifting tool for lifting or upending a flanged object, the lifting tool extending along a central longitudinal tool axis and comprising;

a hoisting member for coupling the lifting tool to a hoisting line and applying a hoisting force to the lifting tool, a main frame for guiding a moveable flange engagement member, said flange engagement member moveably coupled with the main frame for supporting the flanged object, and moveably with respect to the main frame, a driving device coupled with the flange engagement member and the main frame for driving the flange engagement member radially with respect to the central longitudinal tool axis between a flange releasing position for introducing the lifting tool at least partly in said flanged object and past the flange thereof and a flange
(Continued)

supporting position wherein the flange engagement member supports the object, wherein the driving device comprises a linkage system coupled with the hoisting member and the flange engagement member such that the flange engagement member is forced towards its flange supporting position upon application of the hoisting force to the lifting tool.

19 Claims, 4 Drawing Sheets

(58) Field of Classification Search
USPC ..... 294/93, 94, 95, 96, 97
See application file for complete search history.

(56) References Cited

U.S. PATENT DOCUMENTS 3,033,605 A * 5/1962 Morrow, Jr. ..... B29D 30/0016 294/115
3,104,126 A * 9/1963 Lovash ..... B21C 1/14 242/533.7
3,211,490 A * 10/1965 Gardner ..... B66C 1/54 294/194
3,544,151 A 12/1970 Stokes
4,279,438 A * 7/1981 Singh ..... B29D 30/0016 294/195
4,460,210 A * 7/1984 Miechur ..... B66C 1/54 294/97
4,627,654 A * 12/1986 Van Oost ..... B25J 15/103 294/106
8,764,082 B2 * 7/2014 Krogh ..... B66C 1/108 294/67.33
9,663,330 B2 * 5/2017 Moeller ..... B66C 1/62
2015/0165704 A1 * 6/2015 Thalgott, Jr. ..... B29D 30/0016 294/93

FOREIGN PATENT DOCUMENTS

WO 93/09054 A1 5/1993
WO 2012/093940 A1 7/2012

* cited by examiner

FLANGE LIFTING TOOL

BACKGROUND

The present invention relates to a lifting tool for lifting or upending a flanged object.

Such a lifting tool is known from WO2012093940A1 wherein a flange is clamped by a moveable flange engagement member.

DE 89 00 457 U1 relates to a device for holding loads, particularly for lifting objects with a receiving bore, such as industrial grinding wheels. The device reaches through the receiving bore before lifting the load. The device has a number of spring loaded gripping hooks. The gripping hooks are forced against the spring load by a bell shaped flange to a spread stance wherein the object is gripped and can be lifted.

Such a flanged object is in particular an offshore foundation pile. These foundation piles with flanges are usually upended and lifted by hooking a device under the flange. Under circumstances this may provide a poor safety.

Known lifting tools are not suitable for upending and lifting heavy structures with smaller diameter flanges. Furthermore, high stresses are frequently encountered in the transition from the flange to the remainder of the foundation pile.

SUMMARY OF THE INVENTION

The invention aims to provide a lifting tool for lifting or upending a flanged object, which tool is more secure and safe in use.

Another object of the invention is to improve a lifting tool for lifting or upending a flanged object in that a problem associated with known lifting tools is at least partly solved.

Yet another object of the invention is to provide an alternative lifting tool.

According to a first aspect of the invention this is realized with a lifting tool for lifting or upending a flanged object, the lifting tool extending along a central longitudinal tool axis and comprising;

- a hoisting member for coupling the lifting tool to a hoisting line and applying a hoisting force to the lifting tool,
- a main frame for guiding a moveable flange engagement member,
- said flange engagement member moveably coupled with the main frame for supporting the flanged object, and moveably with respect to the main frame,
- a driving device coupled with the flange engagement member and the main frame for driving the flange engagement member radially with respect to the central longitudinal tool axis between a flange releasing position for introducing the lifting tool at least partly in said flanged object and past the flange thereof and a flange supporting position wherein the flange engagement member supports the object, wherein the driving device comprises a linkage system coupled with the hoisting member and the flange engagement member such that the flange engagement member is forced towards its flange supporting position upon application of the hoisting force to the lifting tool.

The linkage system being coupled with the hoisting member and the flange engagement member such that the flange engagement member is forced towards its flange supporting position upon application of the hoisting force to the lifting tool provides an intrinsically safe manner of lifting a flanged object. The flange engagement member is forced towards the outer wall of the flanged object and therefore cannot slip along the flange.

In contrast with the current invention, DE 89 00 457 U1 has no linkage system in conjunction with a main frame that guides a flange engagement member. Instead the device of DE 89 00 457 U1 relies on wedging action to force a gripping hook, that is suspended from a ring portion, into engagement with a load.

It will be understood that safety is paramount when lifting offshore foundation piles that may weigh several hundreds of tons.

The flange engagement member supporting the object is to say that the flange engagement member is configured to bear at least part of the weight of the flanged object. The part of the weight depends on the actual number of flange engagement members used in the lifting tool. In contrast, the moveable flange engagement member of WO2012093940A1 does not bear an object, instead the moveable flange engagement member clamps a flange whereas load is beared by a stationary flange engagement member.

A linkage system per se is well known and also referred to as rod mechanism. Such a linkage system has rod elements that are mutually coupled in a rigid, slideable or hingeable manner. Such a linkage system makes conversions in the mechanical domain. In this case, the hoisting force forces the flange engagement member towards its flange supporting position through the linkage system.

In an embodiment of the invention, the main frame comprises a radial frame member that extends radially with respect to the central longitudinal tool axis, and the radial frame member guides the flange engagement member. This enables to support the flange engagement member in a proper and even way so that the flange engagement member in turn is able to support the flanged object.

In an embodiment of the invention, the driving device comprises a linear actuator coupled with the flange engagement member for driving the flange engagement member independently from the linkage system. This enables to drive the flange engagement member independently from the presence of an actual hoisting force. Such a situation may occur when introducing the lifting tool in a foundation pile which initially is in a horizontal stance. It is conceivable that the linear actuator operates in parallel or in series with the linkage system. Such a linear actuator is usually an hydraulic cylinder, however any suitable actuator is conceivable.

In an embodiment of the invention the linear actuator, is mounted with the radial frame member. This enables a deep integration of the linear actuator and the main frame.

In an embodiment of the invention, the lifting tool comprises a locking member coupled with the flange engagement member for locking the position of the flange engagement member in the flange supporting position or in the flange releasing position. The locking member provides additional safety. It is conceivable that one locking member is configured to lock the position of the flange engagement member in the flange supporting position or in the flange releasing as desired. Alternatively, it is conceivable that for each respective position a respective locking member is provided.

In an embodiment of the invention, the main frame extends in a main frame plane transverse with respect to the central longitudinal tool axis, and wherein the linkage system comprises a first linkage member that extends along the central longitudinal tool axis, is moveably coupled with the main frame and is moveable along the central longitudinal tool axis. The first linkage member enables to introduce the hoisting force in the lifting tool and therewith to force the flange engagement members in their flange supporting position through the linkage system. In particular the first linkage member extending along the central longitudinal tool axis enables to operate a number of respective flange engagement members.

In an embodiment of the invention, the linkage system comprises a second linkage member coupled with the first linkage member and the flange engagement member. The second linkage member enables to convert motion of the first linkage member along the central longitudinal tool axis to motion of the flange engagement member transverse with respect to the central longitudinal tool axis.

In an embodiment of the invention, the first linkage member extends below the flange engagement member. This enables that the flange engagement member is forced towards its flange supporting position upon application of the hoisting force to the lifting tool.

In an embodiment of the invention, the first linkage member is centrally arranged and coincides with the central longitudinal tool axis. This even more enables to operate a number of respective flange engagement members.

In an embodiment of the invention, the hoisting member is coupled with one end of the first linkage member and the second linkage member is coupled between the first linkage member and the flange engagement member. This even more, enables to convert motion of the first linkage member along the central longitudinal tool axis to motion of the flange engagement member transverse with respect to the central longitudinal tool axis.

In an embodiment of the invention, the lifting tool comprises a number of respective flange engagement members each coupled with the driving device. This enables to evenly support the flange of the flanged object. The flange is supported over a larger portion, so mechanical stresses are reduced.

In an embodiment of the invention, the number of respective flange engagement members are arranged around the central axis for evenly supporting the flanged object along the circumference thereof.

In an embodiment of the invention, the driving device comprises a number of respective linkage systems, each coupled to a respective flange engagement member. This enables that all respective flange engagement members contribute to safety of the lifting tool.

In an embodiment of the invention, the driving device comprises a number of respective linear actuators, each coupled to a respective flange engagement member. This enables to drive all the respective flange engagement member independently from the presence of an actual hoisting force.

In an embodiment of the invention, the respective linkage systems have the first linkage member in common. This enables to drive all respective flange engagement members simultaneously which even more improves safety.

According to a further aspect of the invention a method is provided for lifting or upending a flanged object, the lifting tool extending along a central longitudinal tool axis and comprising;

a hoisting member for coupling the lifting tool to a hoisting line and applying a hoisting force to the lifting tool, a main frame for guiding a moveable flange engagement member, said flange engagement member moveably coupled with the main frame for supporting the flanged object, and moveably with respect to the main frame, a driving device coupled with the flange engagement member and the main frame for driving the flange engagement member radially with respect to the central longitudinal tool axis between a flange releasing position for introducing the lifting tool at least partly in said flanged object and past the flange thereof and a flange supporting position wherein the flange engagement member supports the object wherein the driving device comprises a linkage system coupled with the hoisting member and the flange engagement member, wherein the method comprises forcing the flange engagement member towards its flange supporting position through the linkage system by application of the hoisting force to the hoisting member of the lifting tool.

In an embodiment of the invention, the driving device comprises a linear actuator coupled with the flange engagement member, and the method comprises driving the flange engagement member independently from the linkage system. This enable to drive the flange engagement member independently from the presence of a hoisting force. This is the case when a foundation pile is upended from a horizontal position. Initially, there is not hoisting force.

The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DESCRIPTION OF THE DRAWINGS

The invention will be further elucidated referring to embodiments shown in the drawing wherein shown in.

DETAILED DESCRIPTION OF EMBODIMENTS

Figure 1:
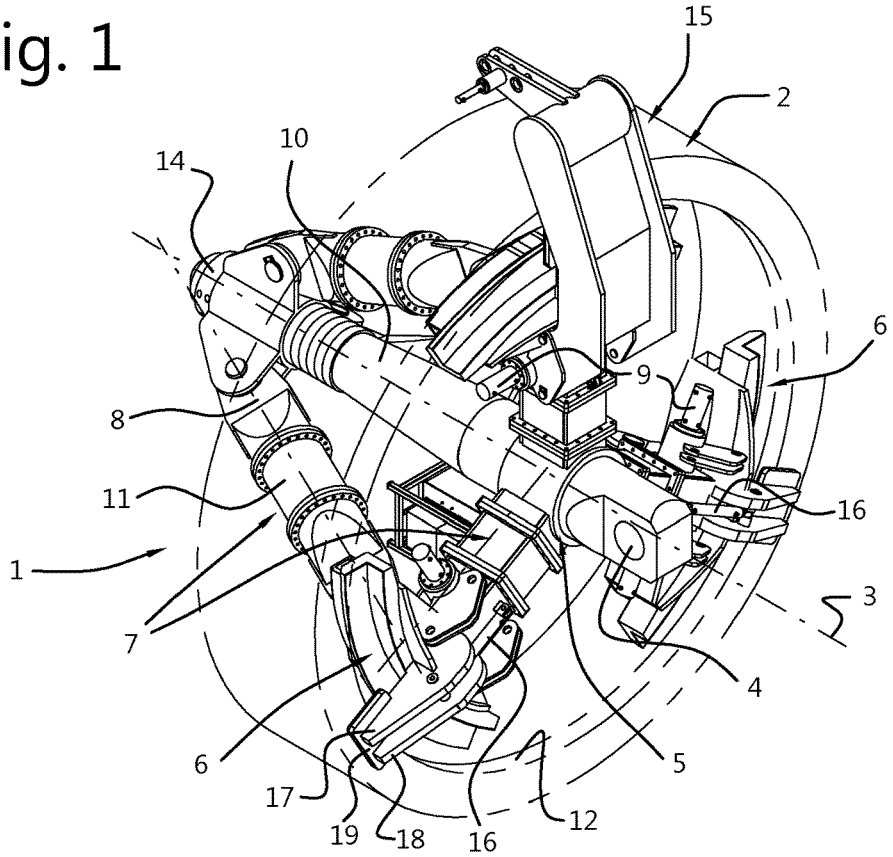
FIG. 1 in perspective view a lifting tool according to the invention.
Figure 2:
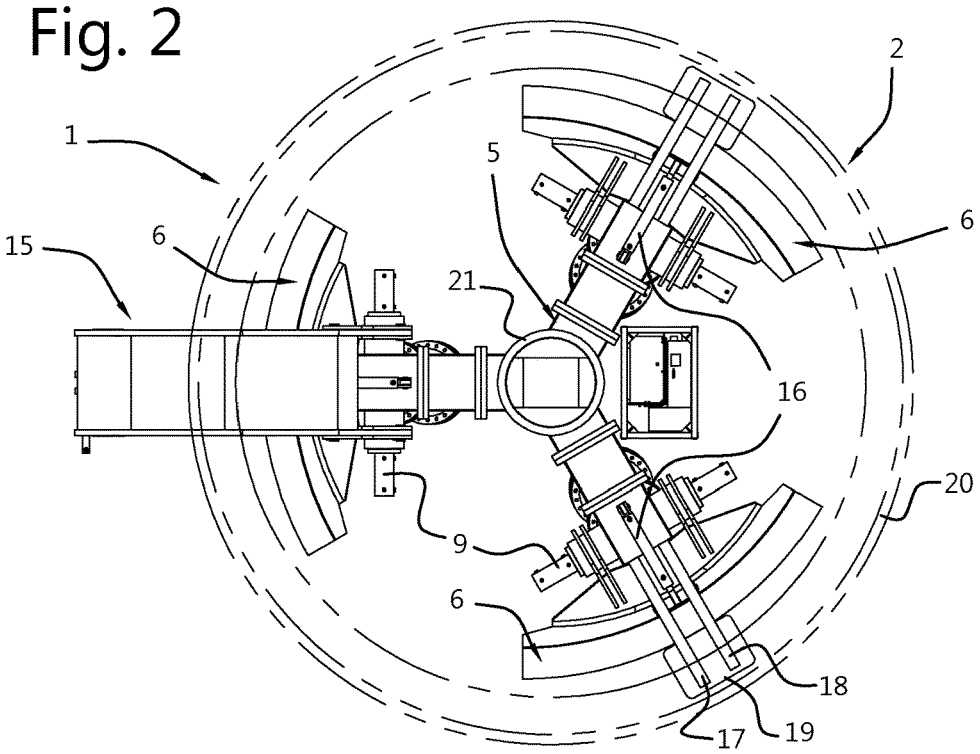
FIG. 2 the lifting tool according to FIG. 1 in top view.
Figure 3:
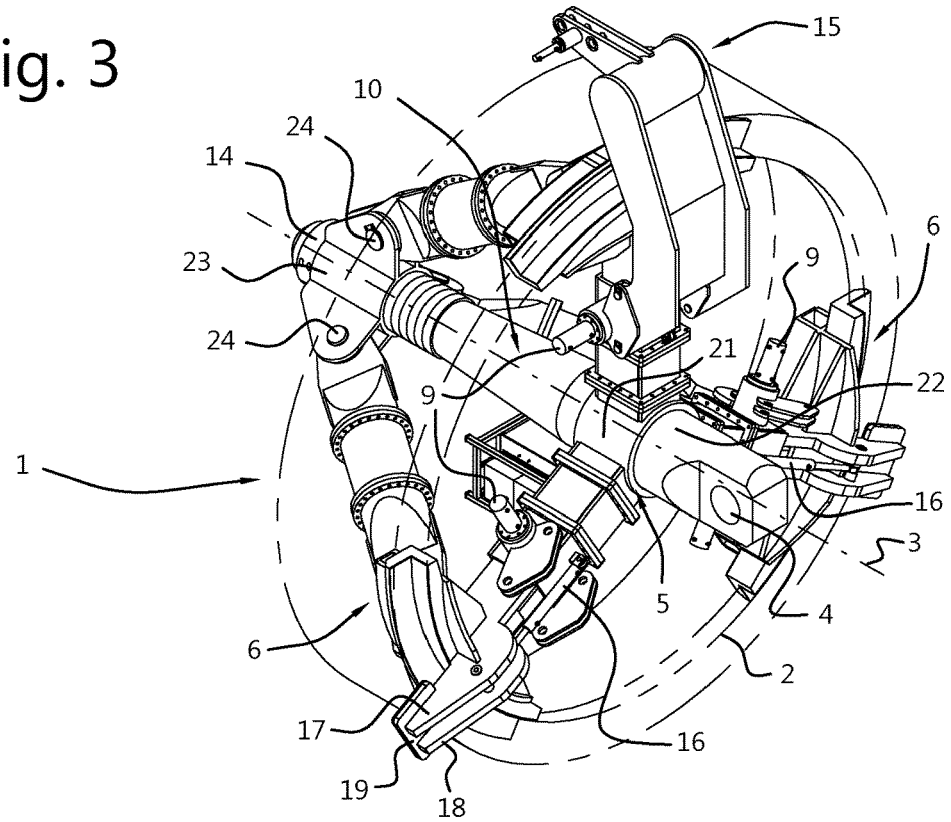
FIG. 3 the view of FIG. 1 with the tool in extended position.
Figure 4:
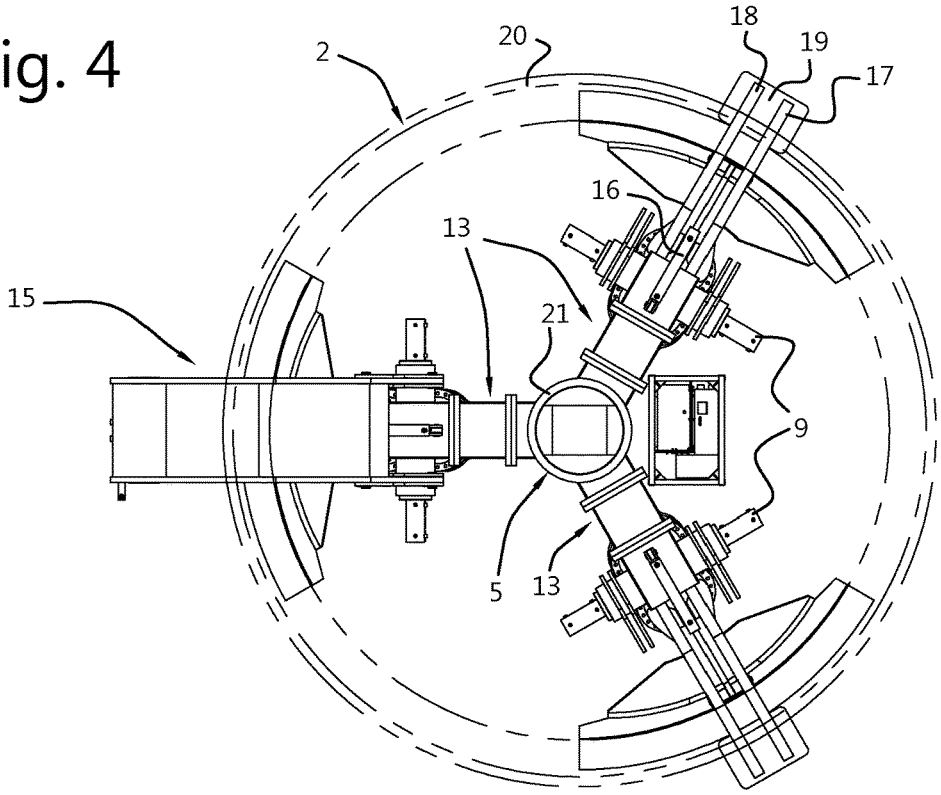
FIG. 4 the view of FIG. 2 with the tool in extended position.

FIG. 1-4 show a lifting tool 1 according to the invention. The lifting tool 1 is configured for lifting or upending a flanged object 2 that is partly shown.

The lifting tool 1 extends along a central longitudinal tool axis 3. In use, the central longitudinal tool axis is aligned with a hoisting line coupled with the lifting tool 1.

The lifting tool 1 comprises a hoisting member 4. The hoisting member 4 is configured for coupling the lifting tool 1 to a hoisting line (not shown). During use, a hoisting force is applied to the lifting tool 1 through the hoisting member 4.

The lifting tool 1 comprises a main frame 5. The main frame 5 provides strength and integrity to the lifting tool 1.

The main frame 5 comprises a radial frame member 13 that extends radially with respect to the central longitudinal tool axis 3. The radial frame member 13 guides the flange engagement member 6 when the flange engagement member 6 is radially moving. Here, the main frame 5 has three radial frame members 13, each provided with a flange engagement member 6.

The main frame 5 extends in a main frame plane transverse with respect to the central longitudinal tool axis 3.

Here, the lifting tool 1 has a boom member 15 to be able to provide additional stability in particular when the lifting tool 1 is used for upending a foundation pile.

The lifting tool 1 comprises a flange engagement member 6. The flange engagement member 6 is moveably coupled with the main frame 5 for supporting the flanged object 2. Coupled for supporting is to say that the coupling is such that a considerable load like an offshore foundation pile can be borne or in other words carried by the flange engagement member 6. The flange engagement member 6 is moveably with respect to the main frame 5. The main frame 5 is configured for guiding a moveable flange engagement member 6.

The lifting tool 1 comprises a driving device 7. The driving device 7 is coupled with the flange engagement member 6 and the main frame 5 for driving the flange engagement member 6. The driving device 7 is configured for driving the flange engagement member 6 radially with respect to the central longitudinal tool axis 3. The flange engagement member 6 is driveable between a flange releasing position shown in FIGS. 1 and 2 for introducing the lifting tool 1 at least partly in the flanged object 2 and past the flange 12 thereof and a flange supporting position shown in for example FIG. 4 wherein the flange engagement member 6 supports the object 2.

The driving device 7 comprises a linkage system 8 clarified through a triangle of a dotted line. The linkage system 8 is coupled with the hoisting member 4 and the flange engagement member 6 such that the flange engagement member 6 is forced towards its flange supporting position upon application of the hoisting force to the lifting tool 1.

The driving device 7 comprises a linear actuator 16. The linear actuator is coupled with the flange engagement member 6 for driving the flange engagement member 6 independently from the linkage system 8. Here, the linear actuator is mounted with the radial frame member 13.

The linkage system 8 comprises a first linkage member 10. The first linkage member 10 extends along the central longitudinal tool axis 3. The first linkage member 10 is moveably coupled with the main frame 5. The first linkage member 10 is moveable along the central longitudinal tool axis 3. Therefore, the main frame 5 comprises a bush 21. The bush 21 is centrally arranged with the main frame 5. The radial frame members 13 are rigidly mounted with the bush 21. The first linkage members 10 extends through a central opening of the bush 21. The first linkage member 10 is slideably coupled with the bush 21. The bush 21 is slidable over the outer surface 22 of the first linkage member 10.

The linkage system 8 comprises a second linkage member 11. The second linkage member 11 is coupled with the first linkage member 10 and the flange engagement member 6. The second linkage member 11 is coupled with the first linkage member 10 at its lower end. In use, the lower end of the first linkage member 10 is opposite the hoisting member 4. The second linkage member 11 is coupled with the first linkage member 10 through a collar 14. The collar 14 is rigidly mounted with the first linkage member 10. The second linkage member 11 is hingeably coupled with the first linkage member 10. The second linkage member 11 is hingeably coupled with the first linkage member 10 and the flange engagement member 6 to constitute the linkage system 8. Therefore, the linkage system 8 comprises a bush 23. The bush 23 is centrally arranged with the lifting tool 1. The second linkage members 11 are hingeably coupled with the bush 23. The first linkage members 10 extends through a central opening of the bush 23. Here, the first linkage member 10 is slideably coupled with the bush 23. All second linkage members 11 are coupled with the first linkage member 10 through the bush 23 that rests on the collar 14.

The first linkage member 10 extends below the flange engagement member 6. That is, during use, the first linkage member 10 extends below the flange engagement member 6. The first linkage member 10 extends from a side of the main frame 5 opposite the hoisting member 4.

Here, the first linkage member 10 is centrally arranged and coincides with the central longitudinal tool axis 3.

The hoisting member 4 is coupled with one end of the first linkage member 10. The second linkage member 11 is coupled between the first linkage member 10 and the flange engagement member 6. The second linkage member 11 is coupled with the first linkage member 10 at an end of the first linkage member 10 opposite the hoisting member 4.

The lifting tool 1 comprises a locking member 9. The locking member 9 is coupled with the flange engagement member 6 for locking the position of the flange engagement member 6 in the flange supporting position or in the flange releasing position.

In this case, the lifting tool comprises a number of, here three, respective flange engagement members. Each of the respective flange engagement members 6 is coupled with the driving device 7. The three respective flange engagement members are arranged around the central axis 3 for evenly supporting the flanged object 2 along the circumference thereof.

Figure 7:
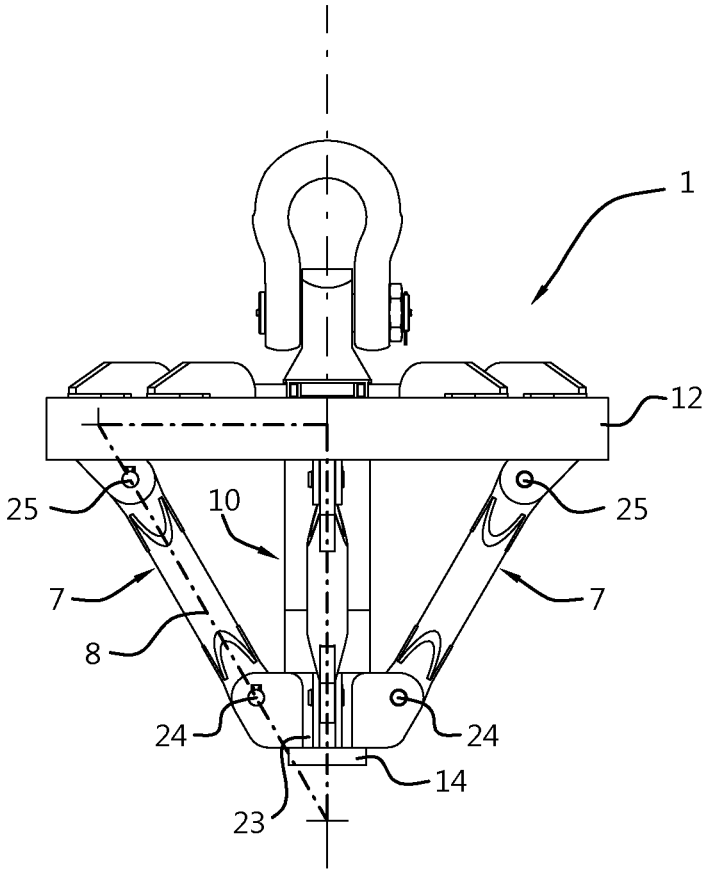
FIG. 7 the lifting tool according to FIG. 5 in side view.

Here, the driving device 7 comprises a number of respective linkage systems 8. Each respective linkage system 8 is coupled to a respective flange engagement member 6. Each linkage system 8 comprises a first linkage member 10, a second linkage member 11 and a radial frame member 13 including a linear actuator. The first linkage member 10 extends along the central longitudinal tool axis 3. The radial frame member 13 extends transverse with respect to the central longitudinal tool axis 3. The second linkage member 11 is hingeably coupled with both the first linkage member 10 and the radial frame member 13. The second linkage member 11 is hingeably coupled with the first linkage member 10 through a hinge 24. The second linkage member 11 is hingeably coupled with the radial frame member 13 through a hinge 25. The first linkage member 10, the second linkage member 11 and the radial frame member 13 together make up a triangular shape as indicated in FIG. 1 and FIG. 7. In this case, the respective linkage systems 8 have the first linkage member 10 in common. This enables to build a compact lifting tool 1 that can lift foundation piles with a relatively small diameter.

Preferably, the driving device 7 comprises a number of respective linear actuators (not shown), each coupled to a respective flange engagement member 6.

The lifting tool 1 comprises abutment members. Here, each radial frame member 13 is provided with an abutment member. The abutment members are arranged with the lifting tool to contact the flanged object 2 at a leading face thereof, usually the upper face 20 of the flanged object 2. The lifting tool 1 rests on the flanged object 2 through the abutment members. The abutment members are configured to temporarily bear the weight of the lifting tool 1. Such an abutment member comprises a support foot 19 for contacting the flanged object. The support foot 19 is positioned at a radius from the central longitudinal tool axis 3. The support foot 19 is positioned through a pair of plate members 17, 18. Both plate members are centrally arranged with respect to a radial frame member 13. Here, the support foot 19 moves in unity with the flange engagement member 6. It is conceivable that in an embodiment, the foot 19 is stationary with respect to the central longitudinal tool axis 3.

Figure 5:
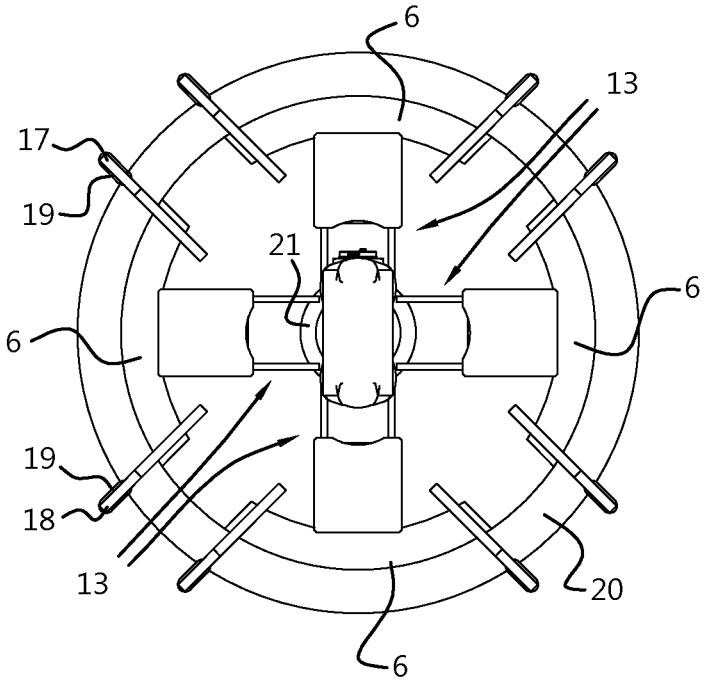
FIG. 5 a top view of another embodiment of the lifting tool according to the invention.
Figure 6:
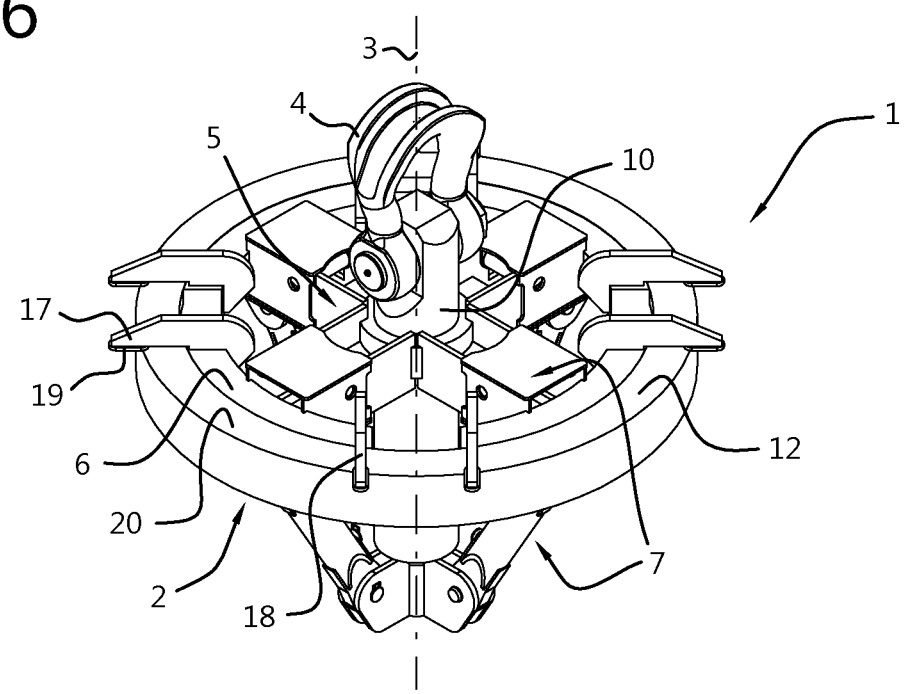
FIG. 6 the lifting tool according to FIG. 5 in perspective view.

FIGS. 5-7 show another embodiment of a lifting tool 1 according to the invention. In general only differences with the first embodiment are described. Here, the main frame 5 has four radial frame members 13, each provided with a flange engagement member 6. The flange engagement member 6 are evenly arranged around the circumference of the lifting tool 1. The plate members 17, 18 are arranged at opposite ends of a flange engagement member 6. Each plate member 17, 18 has a support foot 19. In use, the four flange engagement members 6 support the flanged object 2 along over 50% of the circumference of the flange.

During operation the following method step for lifting or upending a flanged object 2 is executed: Forcing the flange engagement member 6 towards its flange supporting position through the linkage system 8 by application of the hoisting force to the hoisting member 4 of the lifting tool 1. Preferably, the driving device 7 comprises a linear actuator 16 coupled with the flange engagement member 6. The method then comprises driving the flange engagement member 6 independently from the linkage system 8. For example, initially the linear actuator 16 drives the flange engagement member 6 into its flange supporting position. Then, the flange engagement member 6 is forced towards its flange supporting position through the linkage system 8 by the hoisting force during hoisting. Therefore, the flange engagement member 6 maintains its flange supporting position and safety is improved.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A lifting tool for lifting or upending a flanged object, the lifting tool extending along a central longitudinal tool axis and comprising;

a hoisting member for coupling the lifting tool to a hoisting line and applying a hoisting force to the lifting tool, a main frame for guiding a moveable flange engagement member, said flange engagement member moveably coupled with the main frame for supporting the flanged object, and moveably with respect to the main frame, and a driving device coupled with the flange engagement member and the main frame for driving the flange engagement member radially with respect to the central longitudinal tool axis between a flange releasing position for introducing the lifting tool at least partly in said flanged object and past the flange thereof and a flange supporting position wherein the flange engagement member supports the object, wherein the driving device comprises a linkage system coupled with the hoisting member and the flange engagement member such that the flange engagement member is forced towards its flange supporting position upon application of the hoisting force to the lifting tool.

2. The lifting tool according to claim 1, wherein the main frame comprises a radial frame member that extends radially with respect to the central longitudinal tool axis, and the radial frame member guides the flange engagement member.

3. The lifting tool according to claim 1, wherein the driving device comprises a linear actuator coupled with the flange engagement member for driving the flange engagement member independently from the linkage system.

4. The lifting tool according to claim 3, wherein the linear actuator, is mounted with the radial frame member.

5. The lifting tool according to claim 3, wherein the linear actuator comprises an hydraulic cylinder.

6. The lifting tool according to claim 1, comprising a locking member coupled with the flange engagement member for locking the position of the flange engagement member in the flange supporting position or in the flange releasing position.

7. The lifting tool according to claim 1, wherein the main frame extends in a main frame plane transverse with respect to the central longitudinal tool axis, and wherein the linkage system comprises a first linkage member that extends along the central longitudinal tool axis, is moveably coupled with the main frame and is moveable along the central longitudinal tool axis.

8. The lifting tool according to claim 7, wherein the linkage system comprises a second linkage member coupled with the first linkage member and the flange engagement member.

9. The lifting tool according to claim 8, wherein the hoisting member is coupled with one end of the first linkage member and the second linkage member is coupled between the first linkage member and the flange engagement member.

10. The lifting tool according to claim 7, wherein the first linkage member extends below the flange engagement member.

11. The lifting tool according to claim 7, wherein the first linkage member is centrally arranged and coincides with the central longitudinal tool axis.

12. The lifting tool according to claim 11, wherein a hoisting force on the hoisting member moves the first linkage member along the central longitudinal tool axis, which causes the second linkage member to force the flange engagement member into the flange supporting position.

13. The lifting tool according to claim 1, comprising a plurality of respective flange engagement members each coupled with the driving device.

14. The lifting tool according to claim 13, wherein the plurality of respective flange engagement members are arranged around the central axis for evenly supporting the flanged object along the circumference thereof.

15. The lifting tool according to claim 13, wherein the driving device comprises a number of respective linkage systems, each coupled to a respective flange engagement member.

16. The lifting tool according to claim 15, wherein the respective linkage systems have the first linkage member in common.

17. The lifting tool according to claim 13, wherein the driving device comprises a number of respective linear actuators, each coupled to a respective flange engagement member.

18. A method for lifting or upending a flanged object, the lifting tool extending along a central longitudinal tool axis and comprising;

a hoisting member for coupling the lifting tool to a hoisting line and applying a hoisting force to the lifting tool, a main frame for guiding a moveable flange engagement member, said flange engagement member moveably coupled with the main frame for supporting the flanged object, and moveably with respect to the main frame, a driving device coupled with the flange engagement member and the main frame for driving the flange engagement member radially with respect to the central longitudinal tool axis between a flange releasing position for introducing the lifting tool at least partly in said flanged object and past the flange thereof and a flange supporting position wherein the flange engagement member supports the object wherein the driving device comprises a linkage system coupled with the hoisting member and the flange engagement member, wherein the method comprises forcing the flange engagement member towards its flange supporting position through the linkage system by application of the hoisting force to the hoisting member of the lifting tool.

19. The method according to claim 18, wherein the driving device comprises a linear actuator coupled with the flange engagement member, and the method comprises driving the flange engagement member independently from the linkage system.

* * * * *